United States Patent [19]

Schultheis

[11] Patent Number: 5,022,323

[45] Date of Patent: Jun. 11, 1991

[54] PRINTING TOY SEWING MACHINE

[75] Inventor: Douglas A. Schultheis, Cumberland, R.I.

[73] Assignee: Hasbro, Inc., Pawtucket, R.I.

[21] Appl. No.: 453,769

[22] Filed: Dec. 20, 1989

[51] Int. Cl.[5] ..... A63H 33/30; B41F 17/00

[52] U.S. Cl. ..... 101/219; 101/328; 446/474

[58] Field of Search ..... 446/474, 484, 491, 146; 101/219, 228, 233, 234, 328, 329, 330, 331, 375, 376, 377

[56] References Cited

U.S. PATENT DOCUMENTS

| | | | |
|---|---|---|---|
| 987,814 | 3/1911 | Newton | 101/228 X |
| 1,019,107 | 3/1912 | White | 101/219 |
| 2,878,614 | 3/1959 | Argiro et al. | 446/474 |
| 3,191,526 | 6/1965 | Ross | 101/233 X |
| 3,217,639 | 11/1965 | Kelly | 101/233 |
| 3,465,673 | 9/1969 | Oppenheim | 101/328 |
| 3,699,705 | 10/1972 | Clarke et al. | 446/474 |
| 4,412,489 | 11/1983 | Duhamel | 101/377 X |
| 4,593,618 | 6/1986 | Lebensfeld | 101/375 |

*Primary Examiner*—Clifford D. Crowder
*Attorney, Agent, or Firm*—Hasbro, Inc.

[57] ABSTRACT

A toy sewing machine includes a body portion which resembles the body of a conventional sewing machine and a printing mechanism which is operative for applying a printed image to a piece of sheet material as the piece of sheet material is passed through the sewing machine.

8 Claims, 3 Drawing Sheets

PRINTING TOY SEWING MACHINE

BACKGROUND OF THE INVENTION

The instant invention relates to toys, and more particularly to a novel toy sewing machine which is adapted to be utilized by children of various ages without risk of injury.

Toys which simulate various domestic machines and appliances commonly utilized by adults to perform day-to-day domestic activities have generally been found to have relatively high levels of play value. However, for safety reasons, heretofore it has not been possible to incorporate certain types of realistic operating mechanisms into toys of this type and as a result, certain types of heretofore available toys which have simulated domestic machines and appliances have not been capable of operating with sufficient levels of realism to capture the attention of children for extended periods of time. For example, because of the inherent dangers associated with sewing machine mechanisms heretofore it has generally not been possible for toy sewing machines to include realistic operating mechanisms. Hence, the heretofore available toy sewing machines have generally not had sufficient play value to make them popular and effective toys.

The instant invention provides a toy sewing machine which includes a novel and realistic operating mechanism and which is nevertheless capable of being safely operated by children of various ages. More specifically, the toy sewing machine of the instant invention comprises a simulated toy sewing machine body having a simulated sewing station thereon and a simulated sewing machine head located at the sewing station, and image means at the sewing station which is actuatable for applying a printed image to a piece of sheet material passing through the sewing station. The image means is preferably actuatable for printing an image onto a piece of sheet material, and it preferably includes a print wheel and means for applying ink to the print wheel, and the print wheel is positioned so that it is engagable with a piece of sheet material passing through the sewing station for printing an image thereon. The image means preferably further includes a drive mechanism which is actuatable for driving the print wheel, and an idler wheel which is disposed adjacent the print wheel and operable for maintaining a piece of sheet material passing through the sewing station in pressurized engagement with the print wheel. Further, the idler wheel is preferably biased toward the print wheel but nevertheless movable relative to the print wheel to accommodate sheet materials of different thicknesses therebetween. The sewing machine body preferably includes a sewing platform which leads to the sewing station and the image means preferably still further includes a depressible pad on the sewing platform which is depressible for actuating the drive means. The print wheel is preferably detachably mounted at the printing station so that the print wheel can be replaced in order to change the images applied to sheet materials. Specifically, the print wheel means preferably includes a print wheel mounting bracket which is operative for rotatably mounting the print wheel at the printing station. The drive means preferably includes a drive shaft and the print wheel mounting bracket is preferably detachably received on the sewing machine body so that the print wheel is drivingly received on the drive shaft at the sewing station.

It has been found that the toy sewing machine of the instant invention is adapted to operate with a high level of realism, and that as a result, it can be effectively utilized to capture the attention of children for prolonged periods of time. In this regard, because the toy sewing machine is operative for applying images to pieces of sheet material as the pieces of sheet material are passed through the sewing station, the toy sewing machine can be effectively operated to provide high levels of amusement for children. However, because the toy sewing machine is operative for printing images onto pieces of sheet material rather than actually stitching images thereon, it can operate realistically without a hazardous needle mechanism of the type found in most conventional sewing machines.

Toy sewing machine devices representing the closest prior art to the subject invention of which the applicant is aware are disclosed in the U.S. Pats. to Argiro et.al., No. 2,878,614 and Clarke et.al., No. 3,699,705. However, since these references fail to suggest a toy sewing machine which is operative for printing an image onto a piece of sheet material in order to apply simulated stitching thereto, they are believed to be of only general interest with respect to the toy sewing machine of the subject invention. Various printing devices which are also believed to be of only general interest with respect to the subject invention are disclosed in the U.S. Pats. to McKee, No. 1,855,920; Coley, No. 2,467,010; Mercer et.al., No. 2,905,085; McDonough, No. 3,253,542; Oppenheim, No. 3,465,673; Kolody, No. 3,646,885; and Stewart, No. 4,282,809. However, since these references also fail to suggest the concept of incorporating a printing mechanism into a toy sewing machine, the toy sewing machine of the instant invention is believed to represent a new concept in the toy art relating to sewing apparatus.

Accordingly, it is a primary object of the instant invention to provide an effective and amusing toy sewing machine.

Another object of the instant invention is to provide an amusing and realistic toy sewing machine which can be safely operated by young children.

An even further object of the instant invention is to provide a toy sewing machine which is operative for applying a printed image to a piece of sheet material.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 3:
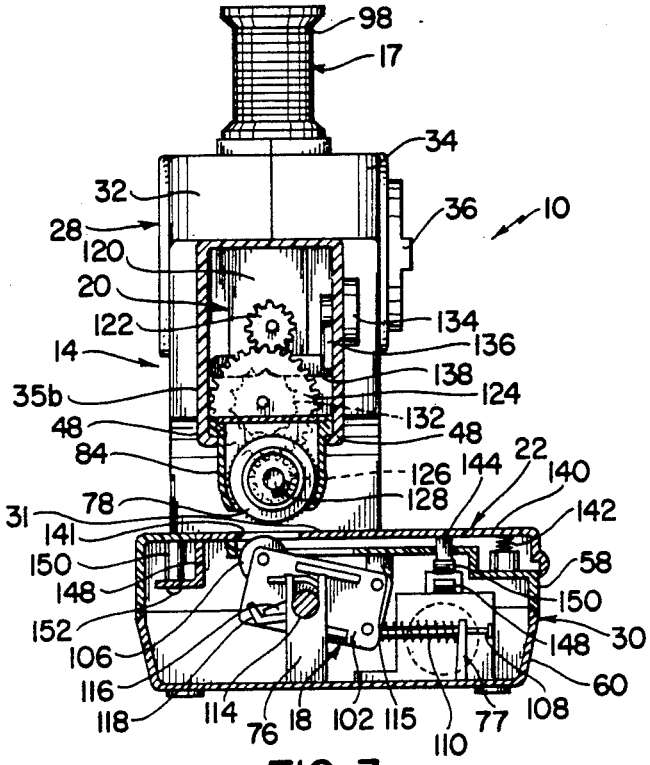
FIG. 3 is a sectional view taken along line 3—3 in FIG. 1.
Figure 4:
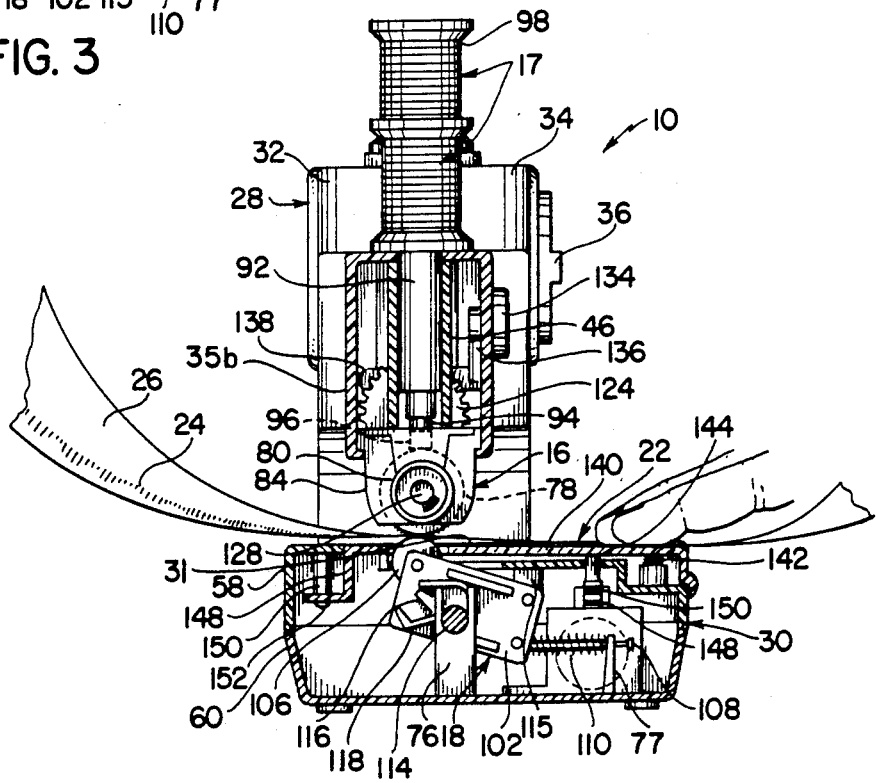
FIG. 4 is a sectional view taken along line 4—4 in FIG. 1 as a printed image is applied to a piece of sheet material.

Referring now to the drawings, the toy sewing machine of the instant invention is illustrated and generally indicated at 10 in FIGS. 1–4. The toy sewing machine 10 comprises a body generally indicated at 12, and a printing mechanism generally indicated at 14 in the body 12. The printing mechanism 14 includes a print wheel assembly generally indicated at 16, an applicator member generally indicated at 17, an idler wheel assembly generally indicated at 18, a drive assembly generally indicated at 20, and an actuator pad assembly generally indicated at 22. As illustrated in FIG. 4, the sewing machine 10 is operative for applying a printed image 24 to a piece of sheet material 26 by depressing the actuator pad assembly 22 to actuate the drive assembly 20 so 15 that the sheet material 26 is drawn between the print wheel assembly 16 and the idler wheel assembly 18.

The body 12 includes an upper body section generally indicated at 28 and a lower body section generally indicated at 30 having a sewing station area 31 thereon. The upper body section 28 includes first and second upper body section halves 32 and 34, respectively, which are received and secured in interfitting engagement with screws (not shown) so that they cooperate to define a housing for the drive assembly 20. The upper body section halves 32 and 34 are formed so that the upper body section 28 resembles the upper portion of a conventional sewing machine. Specifically, the upper body section 28 is formed so that it includes an upwardly extending portion 35 which extends upwardly from the lower body section 30 at a location which is spaced from the sewing station 31, an upper support portion **35*a* and a head portion 35*b*. As will be noted the upper support portion 35*a* extends from the upwardly extending portion 35 in upwardly spaced relation to the lower body section 30 to a point above the sewing station 31, and the head portion 35*b* is supported by the upper support portion 35*a* so that the head portion 35*b* is located above the sewing station 31. A nonfunctional rotatable knob 36 is assembled on the second upper body section half 34, and a plurality of recesses 38 are formed in the second upper body section half 34 beneath the knob 36 for receiving and storing print wheel assemblies, such as the print wheel assembly 16, while not in use. The first and second upper body section halves 32 and 34 cooperate to define a plurality of upwardly opening apertures 40 in the upper body section 28, and a plurality of tubular elements 42 are assembled in the first upper body section 32 so that a tubular element 42 extends downwardly from each of the apertures 40. The first and second upper body section halves 32 and 34, respectively, cooperate to define the simulated sewing head portion 35*b* of the sewing machine 10, having an upwardly opening aperture 44 therein. A tubular member 46 extends downwardly from the aperture 44, and an aperture (not shown) is formed in the head portion 35*b* adjacent the lower end of the tubular member 46. A pair of opposed jaws 48 are formed in the head portion 35*b* adjacent the lower end of the tubular member 46, and a substantially horizontally extending drive shaft aperture 50 is formed in the lower portion of the head portion 35*b*. A vertically elongated opening 52 is formed on the front side of the head portion 35*b*, and a support leg portion 54 having a plurality of engagement tabs 56 thereon extends downwardly from the upper body section 28 below the recesses 38**.

The lower body section 30 includes top and bottom halves 58 and 60, respectively, which cooperate to define a supporting base for the upper body section 28, as well as a housing for the idler wheel assembly 18, the actuator pad assembly 22, and a set of batteries 62. The top and bottom lower body section halves 58 and 60 are configured so that they together resemble the base of a conventional sewing machine and they are retained in assembled relation with screws (not shown). A rectangular opening 64 is formed in the top lower body section half 58, and the support leg portion 54 of the upper body section 28 is received in the opening 64 so that the engagement tabs 56 are snap received in engagement in the opening 64 to retain the upper body section 28 in assembled relation with the lower body section 30. An actuator recess 66 is formed in the top lower body section half 58, and a notch 68 is formed along the lower edge of the top lower body section half 58. A substantially rectangular aperture 69 is formed in the recess 66. Formed in the bottom lower body section half 60 is a battery housing assembly 70 which is operative for receiving the batteries 62, and wires 72 lead to the portions of the drive assembly 20 located in the upper body portion section 28 from the battery housing assembly 70. A detachable cover 74 is provided for covering the lower end of the battery housing assembly 70, a pair of supports 76 is provided in the bottom lower body section half 60 for receiving the idler wheel assembly 18 and a support 77 is also provided in the bottom lower body section half 60 for supporting part of the idler wheel assembly 18 as will hereinafter be more fully set forth.

Figure 1:
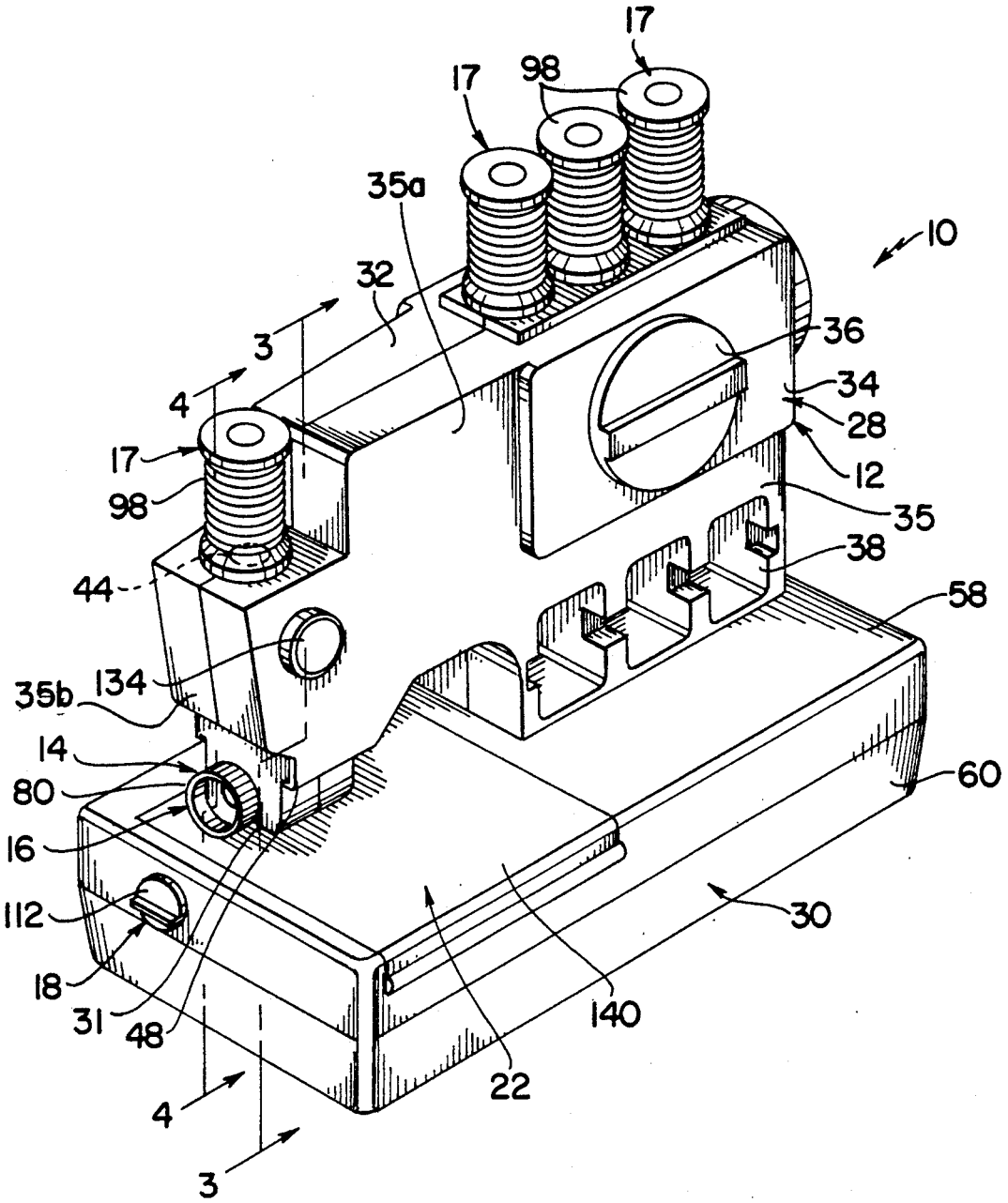
FIG. 1 is a perspective view of the toy sewing machine of the instant invention.
Figure 2:
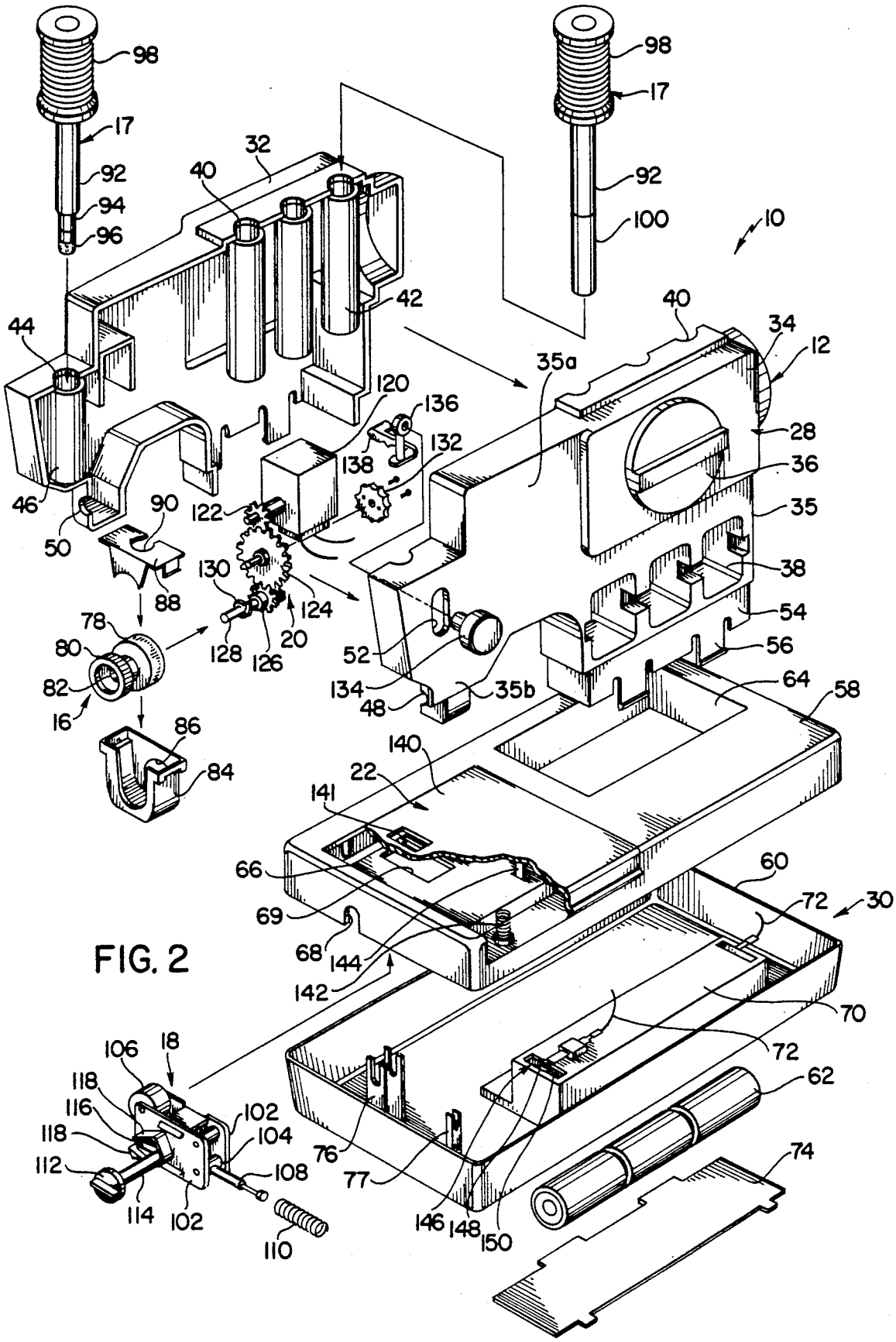
FIG. 2 is an exploded perspective view thereof.

The print wheel assembly 16 comprises an elastomeric print wheel element 78 which includes a cylindrical printing surface having an embossed printing pattern thereon. The embossed printing pattern on the print wheel element 78 preferably resembles a pattern of conventional sewing stitching although the use of various other printing patterns is also contemplated. Attached to the print wheel element 78 is a knob 80 and a central opening having internal female threads therein extends through the combined structure comprising the print wheel element 78 and the knob 80. The print wheel element 78 is received in a lower print wheel housing section 84 having an opening 86 therein, and an upper print wheel housing section 88 having an opening 90 therein is assembled on the lower housing section 84 for retaining the print wheel element 78 therein. The print wheel assembly 16 is received in the jaws 48 in the upper body section 28 so that the print wheel element 78 is positioned at a sewing station 37 as illustrated in FIG. 1. When the print wheel assembly 16 is assembled with the upper body section 28 in this manner, the opening 90 in the upper print wheel housing 10 section 88 is generally aligned with the tubular passage in the tubular member 46 so that ink from the applicator member 17 can be applied to the print wheel element 78.

The applicator member 17 preferably comprises an elongated casing portion 92 containing a supply of ink and a tip portion 94 including an absorbent tip element 96 which communicates with the ink in the casing portion 92 for supplying ink to the tip element 96. The applicator element 17 further comprises a simulated thread spool portion 98 which is assembled on the casing portion 92 at the opposite end thereof from the tip element 96. The applicator element 17 is receivable in the aperture 44 in the upper body section 28 with the casing portion 92 received in the tubular member 46 so that the tip portion 94 extends into the lower print wheel housing section 84 and engages the print wheel element 78. As a result, the tip element 96 of the applicator member 17 is operative for applying ink to the cylindrical surface of the print wheel element 78 as the print wheel element 78 is rotated. In this regard, although only one applicator member 17 is required to operate the toy sewing machine 10, the sewing machine 10 preferably comprises a plurality of additional applicator members 17 containing inks of different colors, and the body portion 12 is adapted for receiving and storing the additional applicator members 17 in the tubular members 42 in the upper body section 28 as illustrated in FIG. 1. The additional applicator members 17 preferably further comprise end caps 100 which are detachably received on the tip portions 94 thereof to prevent drying out of the inks contained in the applicator members 17.

The idler wheel assembly 18 is mounted in the lower body section 30 and it comprises a pair of spaced plates 102 which are separated by a rotatable pin 104, an idler wheel 106 which is rotatably mounted between the plates 102, a biasing pin 108 which extends outwardly from the pin 104, and a biasing spring 110 on the biasing pin 108. The idler wheel assembly 18 further comprises an actuator knob 112 which is mounted on a shaft 114. The idler wheel assembly 18 is pivotally suspended from a support 115 which extends downwardly from the top half 58 of the lower body section 30, and the pin 108 is received in the notch in the support 77 with the spring 110 captured between the support 77 and the pin 104 to bias the idler wheel assembly 18 to an upwardly pivoted position. The shaft 114 is rotatably received in the notches in the supports 76, and a corresponding support (not shown) extends downwardly from the top half 58 between the supports 76. The shaft 114 extends through a pair of enlarged openings in the walls 102 so that the shaft 114 is vertically moveable relative to the walls 102 and a lever 116 extends outwardly from the shaft 114. A retainer wall 118 extends outwardly from one of the walls 102 around the enlarged opening through which the shaft 114 passes, and the lever 116 is engageable with the retainer wall 118 for vertically repositioning the shaft 114 and the knob 112 relative to the remainder of the idler wheel assembly 18. Specifically, by rotating the knob 112 so that the lever arm 116 engages the retaining wall 118, the idler wheel 106 can be moved upwardly or downwardly. More specifically, as illustrated in FIG. 3, by rotating the knob 112 in a counter-clockwise direction, the lever 116 is moved into engagement with the retaining wall 118 to pivot the assembly comprising the idler wheel 106 and the 10 walls 102 so that the idler wheel 106 is moved downwardly relative to the upper surface of the actuator pad assembly 22. Correspondingly, by rotating the knob 112 in a clockwise direction, the lever 116 is disengaged from the retaining wall 118 allowing the assembly comprising the walls 102 and the idler wheel 106 to be pivoted upwardly so that the idler wheel 106 is biased toward a position of engagement with the print wheel 78 by the spring 110. Accordingly, the idler wheel 106 is moveable between an operative position wherein it is biased toward the print wheel 78 and an inoperative position wherein it is maintained in spaced relation to the print wheel element 78. In either position, the idler wheel 106 extends upwardly through the aperture 69 in the recess 66. However, when the idler wheel 106 is in the inoperative position, the upper extremity of the idler wheel 106 is recessed below the upper surface of the actuator pad assembly 22.

The drive assembly 20 comprises an electric motor 120 having a drive gear 122 thereon, a transmission gear 124 which is rotatably mounted in the upper body portion 28 so that it intermeshes with the drive gear 122, and a drive shaft gear 126 which is mounted on a rotatable drive shaft 128. The drive shaft gear 126 intermeshes with the transmission gear 124 and the drive shaft 128 has a single helical thread 130 thereon. The drive shaft 128 is mounted so that it normally projects outwardly through the drive shaft aperture 50 in the head portion 43. Further, the drive shaft 128 is dimensioned so that the print wheel 78 is receivable in threaded engagement with the thread 130 by assembling the print wheel assembly 16 in the jaws 48, and 10 rotating the knob 80 to releasably secure the print wheel 78 on the shaft 128. Attached to the rear side of the transmission gear 124 is a multifaced cam wheel 132, and a knob 134 is received in the slot 52 so that it is vertically slidable therein. Attached to the inner end of the knob 134 is a cam wheel follower member 136 having a follower arm 138. The cam wheel follower member 136 is positioned so that the cam wheel follower arm 138 rides on the surface of the cam wheel 132 to reciprocally move the knob 134 up and down in the slot 52 as the cam wheel 132 is rotated. Also included in the drive assembly 20 are the batteries 62 which are electrically connected to the motor 120 through the wires 72 for powering the motor 120 when the drive assembly 20 is actuated through the actuator pad assembly 22.

The actuator pad assembly 22 comprises an actuator pad 140 having an aperture 141 therein, a pair of springs 142, an actuator arm 144 which extends downwardly from the pad 140 and a contact assembly 146. The actuator pad 140 defines a sewing platform which passes through the sewing station 31 and it includes a flange portion 148 which extends downwardly and then outwardly along the rear edge of the pad 140. The flange portion 148 is secured to posts 150 which extend downwardly from the top half 58 of the lower body section 30 with screws 152. The actuator pad 140 is received in the recess 66 and the springs 142 are received on the top section 58 adjacent the front edge thereof for supporting the front portion of the pad 140. The front portion of the pad 140 is downwardly depressible against the force of the springs 142 to move the actuator arm 144 downwardly into engagement with the contact assembly 146. A pad 140 is further assembled on the top section 58 so that the idler wheel 106 is aligned with the aperture 141 to permit the idler wheel 106 to be moved upwardly toward the print wheel 78 when the idler wheel 106 is in the actuated position. The contact assembly 146 includes fixed and moveable contacts 148 and 150, respectively, and it is interposed in series relation between one of the wires 72 and the batteries 62. Further, the contact assembly 146 is aligned with the actuator arm 144. Accordingly, by depressing the actuator pad 140, the actuator arm 144 is moved downwardly into engagement with the moveable contact 150 to move the movable contact 150 into engagement with the fixed contact 148, and to thereby complete the circuit between the batteries 62 and the motor 120 to actuate the drive motor 120.

For use and operation of the sewing machine 10, the print wheel assembly 16 is assembled at the sewing station 31 so that the print wheel 78 is received in threaded engagement on the shaft 128, and so that the lower housing section 84 is received in the jaws 48. The end cap 100 is then removed from one of the applicator members 17, and the applicator member 17 is assembled in the aperture 44 and into the tubular member 46 so that the applicator tip 96 is received in the aperture 90 in the upper print wheel housing section 88 in order to apply ink to the print wheel element 78. The idler wheel assembly 18 is then moved to the operative position thereof wherein the idler wheel 106 is biased toward a position of engagement with the print wheel element 78. By then passing a piece of sheet material, such as the sheet 26, between the print wheel element 78 and the idler wheel 106 an image, such as the image 24, can be applied to the sheet material 26. Specifically, by depressing the actuator pad 22 and feeding the piece of sheet material 26 between the print wheel element 78 and the idler wheel 106, the drive motor 120 is actuated to rotate the print wheel element 78 so that the piece of sheet material 26 is drawn through the sewing station 92 by the print wheel element 78 and the idler wheel 106. As the print wheel element 78 is rotated to draw the piece of sheet material 26 between the print wheel element 78 and the idler wheel 106, ink is applied to the print wheel element 78 by the applicator member 17 and this ink is then applied by the print wheel element 78 to the piece of sheet material 26 in order to produce the image 24 thereon. Simultaneously, as the drive assembly 20 is operated to apply the image 24 to the piece of sheet material 26, the cam wheel 132 is rotated causing the cam follower 136 to be moved up and down. This causes the knob 134 to be reciprocally moved up and down in the slot 52 to provide a simulated sewing mechanism type action on the front of the sewing machine 10.

It is seen therefore that the instant invention provides an effective toy sewing machine. The sewing machine 10 can be effectively utilized for applying images to sheet materials by passing the sheet materials through the sewing station 31 while simultaneously depressing the actuator pad 140. In addition, as the drive assembly 20 is operated to apply an image 24 to a piece of sheet material 26, the knob 134 is reciprocally moved up and down to produce a simulated sewing mechanism action. Accordingly, the sewing machine 10 is operative for applying images to pieces of sheet material without the hazards associated with sewing needle mechanisms. It has been found that this substantially increases the safety of the toy sewing machine 10, but since the toy sewing machine 10 is nevertheless capable of applying images to sheet materials, it has a high degree of play value. Hence, it is seen that the toy sewing machine of the instant invention represents a significant advancement in the toy art which has substantial commercial value.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy sewing machine comprising:

(a) body means defining a simulated sewing machine body, said body means including a base portion having a simulated sewing station thereon and an upper body portion, said upper body portion including an upwardly extending portion extending upwardly from said base portion at a location which is spaced from said simulated sewing station, an upper support portion extending from said upwardly extending portion in upwardly spaced relation to said base portion to a point above said simulated sewing station and a head portion on said upper support portion above said simulated sewing station; and (b) printing means located at said sewing station for applying a printed image to a piece of sheet material passing through said sewing station.

2. In the toy sewing machine of claim 1, said printing means further characterized as comprising print wheel means and means for applying ink to said print wheel means, said print wheel means being engageable with a piece of sheet material passing through said sewing station for printing an image thereon.

3. In the toy sewing machine of claim 2, said printing means further comprising drive means actuatable for driving said print wheel means.

4. In the toy sewing machine of claim 3, said body including a sewing platform leading to said sewing station, said image means including a depressible pad on said platform, said pad being depressible for actuating said drive means.

5. In the toy sewing machine of claim 3, said print wheel means comprising a print wheel and an idler wheel adjacent said print wheel, said print wheel means being operable by passing a piece of sheet material between said print wheel and said idler wheel, said idler wheel maintaining said piece of sheet material in pressurized engagement with said print wheel as said piece of sheet material is passed through said sewing station.

6. In the toy sewing machine of claim 5, said idler wheel being normally biased toward said print wheel but being positionable in a disengaged position wherein it is maintained in spaced relation to said print wheel

7. In the toy sewing machine of claim 5, said print wheel being detachably mounted at said printing station.

8. In the toy sewing machine of claim 5, said print wheel means further comprising a print wheel mounting bracket, said print wheel being rotatably mounted on said mounting bracket, said printing means further comprising drive means actuatable for driving said print wheel, said drive means including a drive shaft, said print wheel mounting bracket being detachably received on said body so that said print wheel is drivingly received on said drive shaft at said sewing station.

* * * * *